US009982196B2

(12) United States Patent
Atarashiya et al.

(10) Patent No.: US 9,982,196 B2
(45) Date of Patent: May 29, 2018

(54) DEVICE FOR DESTRUCTIVE DISTILLATION OF COAL

(71) Applicant: MITSUBISHI HEAVY INDUSTRIES, LTD., Tokyo (JP)

(72) Inventors: Kenji Atarashiya, Tokyo (JP); Keiichi Sato, Tokyo (JP); Shinji Namba, Tokyo (JP); Tsutomu Hamada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 264 days.

(21) Appl. No.: 14/416,454

(22) PCT Filed: Oct. 8, 2013

(86) PCT No.: PCT/JP2013/077281
§ 371 (c)(1),
(2) Date: Jan. 22, 2015

(87) PCT Pub. No.: WO2014/091816
PCT Pub. Date: Jun. 19, 2014

(65) Prior Publication Data

US 2015/0291883 A1 Oct. 15, 2015

(30) Foreign Application Priority Data

Dec. 14, 2012 (JP) ..... 2012-273340

(51) Int. Cl.
*C10B 47/30* (2006.01)
*C10B 33/00* (2006.01)
(Continued)

(52) U.S. Cl.
CPC ..... *C10B 47/30* (2013.01); *C10B 33/00* (2013.01); *C10B 41/08* (2013.01); *C10K 1/02* (2013.01); *C10K 1/026* (2013.01)

(58) Field of Classification Search
CPC ..... C10B 33/00; C10B 41/08; C10B 41/02; C10B 47/30; C10B 1/10; C10B 53/04; C10K 1/02–1/028
See application file for complete search history.

(56) References Cited

U.S. PATENT DOCUMENTS 2,657,124 A 10/1953 Gaucher
4,247,370 A * 1/1981 Nijhawan ..... C10B 33/003 202/230
(Continued)

FOREIGN PATENT DOCUMENTS

CN 1777466 A 5/2006
CN 101248160 A 8/2008
(Continued)

OTHER PUBLICATIONS

Machine Translation of Foreign Patent Document (DE 3403338 A1) Obtained from Espacenet Apr. 14, 2017.*
(Continued)

*Primary Examiner* — Robby Ramdhanie
*Assistant Examiner* — Briana M Obenhuber
(74) *Attorney, Agent, or Firm* — Westerman, Hattori, Daniels & Adrian, LLP

(57) ABSTRACT

Provided is a device for the destructive distillation of coal, said device suppressing increases in the concentration of mercury within destructively distilled coal generated by the device. The device for the destructive distillation of coal is a rotary kiln in which an inner cylinder is rotatably supported inside an outer cylinder, thermal gas is supplied to interior of the outer cylinder and dried coal is supplied to the interior of the inner cylinder from one end side thereof, the dried coal is subjected to thermal destructive distillation while being moved and agitated from the one end side of the inner cylinder to the other end side thereof due to the inner cylinder being rotated, and destructively distilled coal and
(Continued)

destructively distilled gas are delivered from the other end side of the inner cylinder.

4 Claims, 10 Drawing Sheets

(51) Int. Cl.
*C10B 41/08* (2006.01)
*C10K 1/02* (2006.01)

(56) References Cited

U.S. PATENT DOCUMENTS

| | | | | | |
|---|---|---|---|---|---|
| 4,330,372 | A * | 5/1982 | Cairns | C10B 33/003 | 201/41 |
| 4,640,681 | A * | 2/1987 | Steinbiss | C04B 7/4446 | 106/745 |
| 4,658,857 | A * | 4/1987 | Ayres, Jr. | F16K 1/223 | 137/601.11 |
| 4,829,912 | A * | 5/1989 | Alliston | B01J 8/1809 | 110/245 |
| 5,057,189 | A * | 10/1991 | Apffel | C09C 1/482 | 202/113 |
| 5,087,269 | A | 2/1992 | Cha et al. | | |
| 5,423,891 | A * | 6/1995 | Taylor | C10J 3/06 | 48/197 A |
| 6,203,765 | B1 * | 3/2001 | Taciuk | B01J 19/28 | 196/112 |
| 2010/0187087 | A1 * | 7/2010 | Lonardi | C10B 27/06 | 202/96 |
| 2011/0011722 | A1 | 1/2011 | Rinker | | |

FOREIGN PATENT DOCUMENTS

| | | | | |
|---|---|---|---|---|
| CN | 101932376 | A | 12/2010 | |
| DE | 3403338 | A1 * | 8/1985 | C10B 27/06 |
| EP | 2390301 | A2 | 11/2011 | |
| FR | 2833605 | A1 | 6/2003 | |
| JP | 6-25673 | A | 2/1994 | |
| JP | 10-230137 | A | 9/1998 | |
| JP | 2003-176985 | A | 6/2003 | |
| JP | 2004-3738 | A | 1/2004 | |
| JP | 2004003738 | A * | 1/2004 | |
| JP | 2006-89567 | A | 4/2006 | |
| JP | 2006089567 | A * | 4/2006 | |
| JP | 2013-189554 | A | 9/2013 | |

OTHER PUBLICATIONS

Machine Translation of Foreign Patent Document (JP 2004003738 A1) Obtained from Espacenet Apr. 13, 2017.*

Machine Translation of Foreign Patent Document (JP 2006089567 A) Obtained from Espacenet Apr. 13, 2017.*

Extended (supplementary) European Search Report dated Jul. 7, 2016, issued in counterpart European Patent Application No. 13861879.8. (9 pages).

Chinese Office Action dated Nov. 23, 2015 issued in counterpart Chinese patent application No. 201380037365.5, with English translation (11 pages).

Office Action dated Sep. 1, 2015, issued in counterpart Australian application No. 2013358355 (4 pages).

International Search Report dated Dec. 10, 2013, issued in counterpart International Application No. PCT/JP2013/077281 (1 page).

Notification of Transmittal of Translation of the International Preliminary Report on Patentability (Forms PCT/IB/338) issued in counterpart International Application No. PCT/JP2013/077281 dated Jun. 25, 2015, with Forms PCT/IB/373 and PCT/ISA/237 (7 pages).

* cited by examiner

DEVICE FOR DESTRUCTIVE DISTILLATION OF COAL

TECHNICAL FIELD

The present invention relates to a coal pyrolizing device.

BACKGROUND ART

Since low-rank coal (low-quality coal) containing a large amount of water such as brown coal and subbituminous coal has a low heating value per unit weight, the low-rank coal is heated to be dried and pyrolized and is also upgraded in a low oxygen atmosphere to reduce surface activity. The low-rank coal is thereby turned into upgraded coal which has an improved heating value per unit weight while being prevented from spontaneously combusting.

For example, a rotary kiln-type coal pyrolizing device as follows is known as a coal pyrolizing device configured to pyrolize the dry coal produced by drying the low-rank coal. An inner tube (cylinder main body) is rotatably supported inside a fixedly-held outer tube (jacket). Heating gas is supplied to an inside of the outer tube (a space between the outer tube and the inner tube) and the dry coal is supplied into the inner tube from one end side thereof. The dry coal is then heated and pyrolized while being agitated and moved from the one end side to the other end side of the inner tube by rotating the inner tube. Then, the pyrolized coal and the pyrolysis gas are sent out from the other end side of the inner tube.

PRIOR ART DOCUMENT

Patent Document

Patent Document 1: Japanese Patent Application Publication No. 2003-176985

Patent Document 2: Japanese Patent Application Publication No. 2004-003738

Patent Document 3: Japanese Patent Application Publication No. Hei 10-230137

SUMMARY OF THE INVENTION

Problems to be Solved by the Invention

When the dry coal is pyrolized, pyrolysis gas (thermal decomposition gas) is generated which contains not only carbon monoxide, water vapor, and tar but also a small amount of mercury-based substances such as HgS and $HgCl_2$ contained in the dry coal.

Moreover, in the aforementioned rotary kiln-type coal pyrolizing device, although a high temperature can be maintained in a portion (center portion in an axial direction) of the inside of the inner tube which is covered with the outer tube and which is heated by the heating gas, drop of the temperature occurs in a portion (portion on the other end side in the axial direction) which protrudes from the outer tube without being covered with the outer tube and which is not heated by the heating gas.

Accordingly, when the pyrolized coal and the pyrolysis gas in the inner tube of the coal pyrolizing device move inside the inner tube to the other end side thereof, the temperature of the pyrolized coal and the pyrolysis gas drops. As a result, the mercury-based substances in the pyrolysis gas are physically-adsorbed onto the pyrolized coal, and the mercury concentration in the pyrolized coal sent out from the other end side of the inner tube increases. Meanwhile, when the temperature of the pyrolized coal is high, the mercury-based substances in the pyrolysis gas are chemically-adsorbed onto the pyrolized coal, and the mercury concentration in the pyrolized coal sent out from the other end side of the inner tube increases.

In view of this, an object of the present invention is to provide a coal pyrolizing device capable of suppressing an increase of mercury concentration in produced pyrolized coal.

Means for Solving the Problems

A coal pyrolizing device according to a first aspect of the invention for solving the problems described above is a rotary kiln-type coal pyrolizing device characterized in that an inner tube is rotatably supported inside an outer tube, heating gas is supplied into the outer tube, coal is supplied into the inner tube from one end side of the inner tube and is heated and pyrolized while being agitated and moved from the one end side to another end side of the inner tube by rotating the inner tube, pyrolized coal and pyrolysis gas are sent out from the other end side of the inner tube, and the coal pyrolizing device comprises: pyrolized coal discharging means, provided to be connected to the other end side of the inner tube, for discharging the pyrolized coal; gas discharging means, provided to be connected to the pyrolized coal discharging means, for discharging the pyrolysis gas; and gas flow-velocity regulating means, provided in the pyrolized coal discharging means, for regulating a flow velocity of the pyrolysis gas discharged to the gas discharging means.

A coal pyrolizing device of a second aspect of the invention for solving the problems described above is the coal pyrolizing device of the first aspect of the invention, characterized in that the pyrolized coal discharging means is a chute, and the gas flow-velocity regulating means includes a partition plate which partitions a space inside the chute into a portion on the inner tube side and a portion on the gas discharging means side while allowing the pyrolysis gas to be discharged to the gas discharging means side and which is capable of adjusting a size of a horizontal cross section of the portion on the gas discharging means side in the space inside the chute.

A coal pyrolizing device of a third aspect of the invention for solving the problems described above is the coal pyrolizing device of the second aspect of the invention, characterized in that the partition plate is formed of two plate bodies which are provided on an output shaft of a motor and whose front end portion sides are swingable in a horizontal direction by an actuation the motor.

A coal pyrolizing device of a fourth aspect of the invention for solving the problems described above is the coal pyrolizing device of the second aspect of the invention, characterized in that the partition plate is formed of a plate body which is provided on a cylinder rod of a drive cylinder and which is capable of advancing toward and retreating from the inner tube by an actuation the drive cylinder.

A coal pyrolizing device of a fifth aspect of the invention for solving the problems described above is the coal pyrolizing device of the second aspect of the invention, characterized in that the partition plate is formed of a plate body which is provided on an output shaft of a motor and which has at least one end portion side swingable relative to the inner tube by an actuation the motor.

A coal pyrolizing device of a sixth aspect of the invention for solving the problems described above is the coal pyrolizing device of the fifth aspect of the invention, characterized in that the coal pyrolizing device comprises a plurality of sets of the plate bodies.

A coal pyrolizing device of a seventh aspect of the invention for solving the problems described above is the coal pyrolizing device of the first aspect of the invention, characterized in that the coal pyrolizing device further comprises: gas state detecting means capable of detecting the gas flow velocity of the pyrolysis gas discharged by the gas discharging means; and control means for controlling the gas flow-velocity regulating means on the basis of the gas flow velocity detected by the gas state detecting means.

A coal pyrolizing device of an eighth aspect of the invention for solving the problems described above is the coal pyrolizing device of the second aspect of the invention, characterized in that the gas flow-velocity regulating means includes centrifuging means for separating the pyrolized coal from the pyrolysis gas by centrifugation, and the partition plate is a plate body provided in a feed pipe configured to feed the pyrolysis gas and the pyrolized coal from the pyrolysis discharging means to the centrifuging means.

Effect of the Invention

In the coal pyrolizing device of the present invention, the following can be achieved. When the temperature of the pyrolized coal drops in a portion not heated by the heating gas, most of mercury-based substances in the pyrolysis gas are physically-adsorbed onto fine pyrolized coal in the pyrolized coal because the particle diameter of the fine pyrolized coal is far smaller than an average particle diameter and the specific surface area per unit weight of the fine pyrolized coal is far greater than that of the pyrolized coal of the average particle diameter. Moreover, even if no physical adsorption occurs, the mercury-based substances in the pyrolysis gas are chemically-adsorbed onto the fine pyrolized coal in the pyrolized coal when the temperature of the pyrolized coal exceeds the limit temperature of chemical adsorption. However, by regulating the gas flow velocity of the pyrolysis gas discharged from the gas discharging means with the gas flow-velocity regulating means, it is possible to entrain, in the pyrolysis gas, fine particles whose particle diameter is far smaller than the average particle diameter of the pyrolized coal, and separate the fine pyrolized coal from the pyrolized coal. Hence an increase of mercury concentration in the produced pyrolized coal can be suppressed.

BRIEF DESCRIPTION OF THE DRAWINGS

FIG. 1 is a schematic configuration diagram of a first embodiment of a coal pyrolizing device in the present invention.

FIG. 5 is a schematic configuration diagram of a second embodiment of the coal pyrolizing device in the present invention.

FIG. 6 is a schematic configuration diagram of a third embodiment of the coal pyrolizing device in the present invention.

FIG. 7 is a schematic configuration diagram of a fourth embodiment of the coal pyrolizing device in the present invention.

FIG. 9 is a schematic configuration diagram of a sixth embodiment of the coal pyrolizing device in the present invention.

MODE FOR CARRYING OUT THE INVENTION

Embodiments of a coal pyrolizing device of the present invention are described based on the drawings. However, the present invention is not limited to the embodiments described below based on the drawings.

First Embodiment

A first embodiment of the coal pyrolizing device of the present invention is described based on FIGS. 1A, 1B, 2, 3, and 4.

Figure 1A:
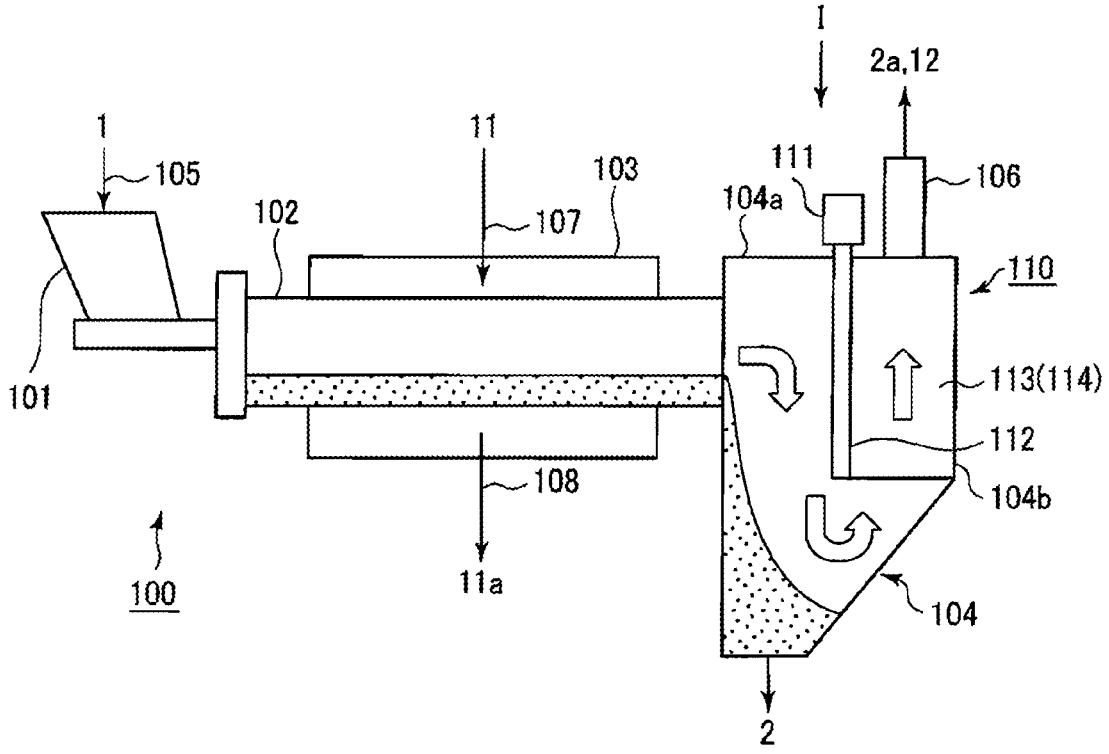
FIG. 1A shows a main portion thereof.

As shown in FIG. 1A, a coal pyrolizing device 100 for pyrolizing dry coal 1 produced by drying low-rank coal (low-quality coal) which is coal containing a large amount of moisture such as brown coal and subbituminous coal includes: a hopper 101 which receives the dry coal 1 from a dry coal conveying line 105 configured to convey the dry coal 1; a rotatably-supported inner tube (cylinder main body) 102 into which the dry coal 1 in the hopper 101 is supplied from one end side (base end side); an outer tube (jacket) 103 which is fixedly supported to cover an outer peripheral surface of the inner tube 102 while allowing the inner tube 102 to rotate and which is configured such that heating gas 11 being a heating medium is supplied to an inside of the outer tube 103 (space between the outer tube 103 and the inner tube 102); and a chute (chamber) 104 which is connected to the other end side (front end side) of the inner tube 102 to allow the inner tube 102 to rotate and which sends out pyrolized coal 2 by causing the pyrolized coal 2 to fall from the other end side (front end side) of the inner tube 102. Note that a side wall 104*b* of the chute 104 is formed in an arc shape in a horizontal cross section.

One end side (base end side) of an exhaust line 106 for discharging pyrolysis gas (heat decomposition gas) 12 such as carbon monoxide, water vapor, and tar as well as fine pyrolized coal 2*a* entrained in the pyrolysis gas 12 is connected to a top plate 104*a* which is an upper portion of the chute 104 of the coal pyrolizing device 100. The other end side (front end side) of the exhaust line 106 is connected to a combustion furnace (not illustrated) into which air and a combustion aid are supplied.

A heating gas feed line 107 whose base end side is connected to the combustion furnace and which feeds the heating gas 11 generated by combusting the air and the combustion aid in the combustion furnace is connected to the inside of the outer tube 103. Moreover, one end side (base end side) of an exhaust gas line 108 for discharging exhaust gas 11*a* of the heating gas 11 from the outer tube 103 is connected to the inside of the outer tube 103. Note that a blower (not illustrated) is provided in a system formed of the exhaust line 106, the combustion furnace, the heating gas feed line 107, and the exhaust gas line 108, and the pyrolysis gas 12, the fine pyrolized coal 2*a*, the heating gas 11, the exhaust gas 11*a* and the like can flow through the exhaust line 106, the heating gas feed line 107, and the exhaust gas line 108.

Figure 1B:
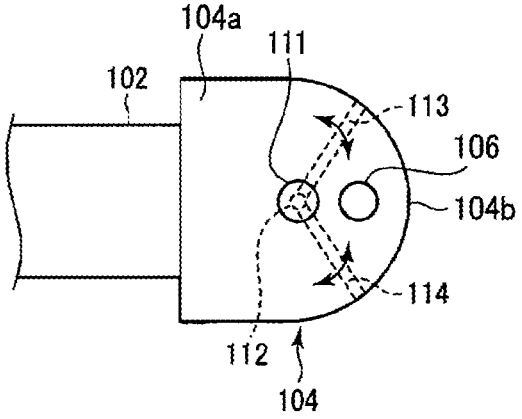
FIG. 1B shows a view in a direction of the arrow I in FIG. 1.

Moreover, as shown in FIGS. 1A and 1B, the chute 104 is provided with a gas flow-velocity regulating device 110 which sections the chute 104 into a space including a portion communicating with the inner tube 102 and a space including a portion connected to the exhaust line 106 while allowing the pyrolysis gas 12 and the fine pyrolized coal 2*a* to be exhausted and which can change the sizes of these spaces and regulate a terminal velocity being a flow velocity of the pyrolysis gas 12. The gas flow-velocity regulating device 110 includes a motor 111 and two partition plates 113, 114 which are provided with one end sides (base end sides) thereof being connected to an output shaft 112 (shaft body) of the motor 111 and whose other end sides (front end sides) swing in circumferential directions along the side wall 104*b* of the chute 104 with rotation of the output shaft 112. Note that the output shaft 112 is formed in a shape extending in a height direction of the chute 104.

The size of each of the partition plates 113, 114 is substantially the same as that of a space between the output shaft 112 and the side wall 104*b* of the chute 104, and the partition plates 113, 114 are plate bodies large enough to extend from the top plate 104*a* of the chute 104 to below the portion communicating with the inner tube 102. The partition plates 113, 114 are made of the same material as the chute 104 and are made of, for example, steel plates. The output shaft 112 is rotated by an actuation the motor 111 performed by controlling the motor 111, and the two partition plates 113, 114 are thereby moved in directions moving away from each other or in directions coming close to each other. In other words, the front end portion sides of the partition plates 113, 114 are swingable in a horizontal direction.

The aforementioned terminal velocity of the pyrolysis gas 12 is the speed at the time when the pyrolysis gas 12 is discharged from the inside of the chute 104 to the exhaust line 106. The terminal velocity of the pyrolysis gas 12 changes depending on the size of a horizontal cross section of a space formed below the exhaust line 106 by the side wall 104*b* of the chute 104 and the partition plates 113, 114. There is a correlation between the terminal velocity of the pyrolysis gas 12 and the particle diameter of the fine pyrolized coal 2*a* entrained in the pyrolysis gas 12. The particle diameter of the fine pyrolized coal 2*a* entrained in the pyrolysis gas 12 becomes larger as the terminal velocity of the pyrolysis gas 12 becomes faster, and the particle diameter of the fine pyrolized coal 2*a* entrained in the pyrolysis gas 12 becomes smaller as the terminal velocity of the pyrolysis gas 12 becomes slower.

In such an embodiment, the coal pyrolizing device 100 is formed of the hopper 101, the inner tube 102, the outer tube 103, the chute 104, the gas flow-velocity regulating device 110 and the like; pyrolized coal discharging means is formed of the chute 104 and the like; gas discharging means is formed of the chute 104, the exhaust line 106, and the like; and the gas flow-velocity regulating device 110 which is gas flow-velocity regulating means is formed of the motor 111, the output shaft 112, the partition plates 113, 114, and the like.

Next, main operations of the coal pyrolizing device 100 are described.

The heating gas (about 1000 to 1100° C.) 11 is supplied to the outer tube 103 of the coal pyrolizing device 100, and the dry coal (average particle diameter: about 5 mm, about 150 to 200° C.) 1 is put into the hopper 101 and supplied into the inner tube (cylinder main body) 102. The dry coal 1 is then moved from the one end side to the other end side of the inner tube 102 while being agitated with rotation of the inner tube 102, and is thereby thoroughly heated and pyrolized (about 350 to 450° C.) by the heating gas (about 1000 to 1100° C.) 11 fed to the outer tube 103 to become the pyrolized coal (average particle diameter: about 5 mm) 2. The pyrolized coal 2 is supplied into a hopper (not illustrated) of a cooling device (not illustrated) via the chute 104.

The pyrolysis gas (about 350 to 450° C.) 12 generated in the pyrolysis performed in the inner tube 102 of the coal pyrolizing device 100 is fed from the upper portion of the chute 104 to the combustion furnace (not illustrated) through the exhaust line 106, and is combusted together with inert gas (containing carbon monoxide) and air (and also with the combustion aid as needed) to be used for the generation of the heating gas 11.

In this case, in the rotary kiln-type coal pyrolizing device 100, temperature drop occurs in a portion (the other end side in an axial direction) of the inner tube 102 which protrudes from the outer tube 103 without being covered with the outer tube 103 and which is not heated by the heating gas 11 as described above. Accordingly, the mercury-based substances are physically-adsorbed onto the pyrolized coal again in the portion (the other end side in an axial direction) of the inner tube which protrudes from the outer tube without being covered with the outer tube and which is not heated by the heating gas. Moreover, even in a case where no physical adsorption occurs, the mercury-based substances in the pyrolysis gas are chemically-adsorbed onto the fine pyrolized coal in the pyrolized coal when the temperature of the pyrolized coal exceeds the limit temperature of chemical adsorption, and the mercury concentration in the pyrolized coal sent out from the other end side of the inner tube increases.

Moreover, since the space volume of the chute (chamber) is fixed in the conventional rotary kiln-type coal pyrolizing device, the space gas flow velocity changes when the operation conditions of the coal pyrolizing device change, and the particle diameter of the fine pyrolized coal conveyed by the pyrolysis gas discharged from the exhaust line is determined depending on the situation. Hence, it is impossible to control the particle diameter of the fine coal to be separated by an air flow of the pyrolysis gas.

The coal pyrolizing device 100 of the embodiment made in view of such problems further performs the following operation to regulate the gas flow velocity of the pyrolysis gas 12 discharged from the exhaust line 106 and suppress an increase of mercury concentration in the pyrolized coal 2.

The motor 111 is controlled and driven to rotate the output shaft 112 of the motor 111, and the other end sides of the partition plates 113, 114 are moved. This adjusts the size of the horizontal cross section of the space surrounded by the partition plates 113, 114 and the side wall 104*b* of the chute 104 below the exhaust line 106, and the gas flow velocity (terminal velocity) of the pyrolysis gas 12 flowing toward the exhaust line 106 is thereby regulated.

The dry coal 1 supplied into the hopper 101 moves inside the inner tube 102 from the one end side to the other end side thereof with the rotation of the inner tube 102 while being thoroughly heated and pyrolized (about 350 to 450° C.) by the heating gas 11 to become the pyrolized coal 2 as described above. Meanwhile, the dry coal 1 produces the pyrolysis gas 12 which contains a small amount of gas of mercury-based substances such as HgS and $HgCl_2$.

Then, when the pyrolized coal 2 moves inside the inner tube 102 to the other end side thereof and reaches the portion not heated by the heating gas 11 and the temperature of the pyrolized coal 2 drops, most of the mercury-based substances in the pyrolysis gas 12 are physically-adsorbed or chemically-adsorbed more to the fine pyrolized coal 2*a* than to the pyrolized coal 2, because the fine pyrolized coal 2*a* in the pyrolized coal (average particle diameter: about 5 mm) 2 is far smaller than the pyrolized coal 2 and the specific surface area per unit weight of the fine pyrolized coal 2*a* is far greater than that of the pyrolized coal 2.

Figure 2:
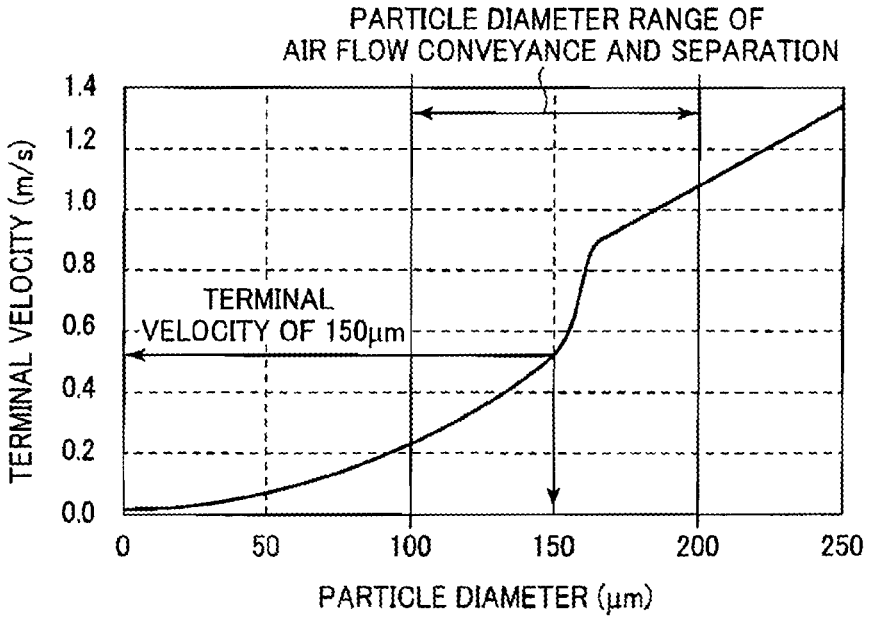
FIG. 2 is a graph showing a relationship between a terminal velocity of pyrolysis gas in a chute of the coal pyrolizing device and a particle diameter of coal conveyed by the pyrolysis gas.
Figure 3:
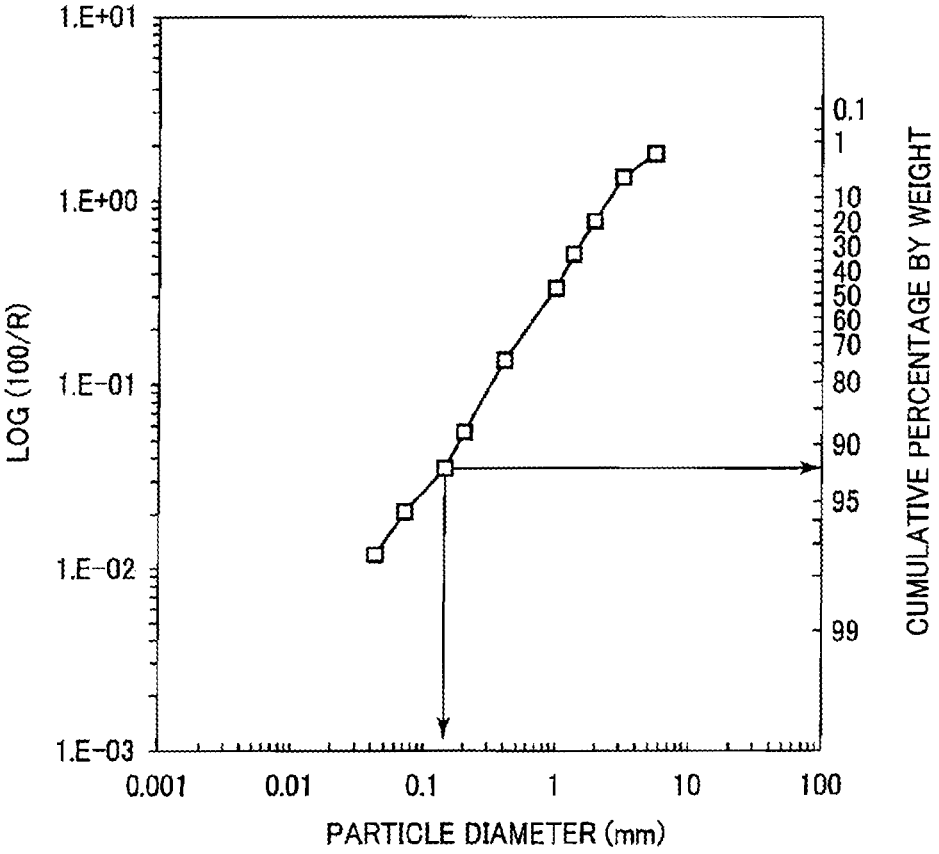
FIG. 3 is a graph showing particle size distribution of pyrolized coal produced by the coal pyrolizing device.

Here, referring to FIGS. 2 and 3, description is given of an example of a relationship between the gas flow velocity (terminal velocity) of the pyrolysis gas 12 in the chute (chamber) 104 which is discharged from the inside of the chute (chamber) 104 to the exhaust line 106 and the particle diameter of the fine pyrolized coal 2*a* entrained in the pyrolysis gas 12 and an example of the yield of the pyrolized coal.

First, it is known that the temperature drop of the pyrolized coal 2 causes re-adsorption of the mercury-based substances in the pyrolysis gas 12 onto a surface of the pyrolized coal 2 due to the physical adsorption thereof, and a proportion of the mercury-based substances re-adsorbed onto the fine pyrolized coal 2*a* which is the pyrolized coal with a particularly small particle diameter is great. In view of this, in a case where the particle diameter of the fine pyrolized coal 2*a* entrained in the pyrolysis gas 12 discharged from the chute 104 is set to, for example, 150 μm, it is found that the fine pyrolized coal 2*a* having the particle diameter of 150 μm can be entrained in the pyrolysis gas 12 by setting the gas flow velocity (terminal velocity) of the pyrolysis gas 12 discharged from the chute 104 to a velocity little less than 0.6 m/s as shown in FIG. 2.

Although the particle diameter of the pyrolized coal onto which a large proportion of the mercury-based substances in the pyrolysis gas are re-adsorbed changes depending on a pyrolysis process (pyrolizing temperature, initial mercury concentration of the pyrolized coal, and the like), it varies substantially within a range of plus and minus 50 μm of the particle diameter of 150 μm. It is thus possible to entrain fine pyrolized coal having a particle diameter of 100 μm to 200 μm in the pyrolysis gas by controlling the gas flow velocity (terminal velocity) of the pyrolysis gas discharged from the chute within a range of 0.25 m/s to 1.1 m/s, and thereby suppress the increase of mercury concentration in the produced pyrolized coal, i.e. the pyrolized coal sent out from a lower portion of the chute.

Moreover, as shown in FIG. 3, when the fine pyrolized coal 2*a* having the particle diameter of 150 μm is separated, the yield of the pyrolized coal 2 is about 92%. Accordingly, it is confirmed that reduction of production efficiency due to removal of the fine pyrolized coal 2*a* from the pyrolized coal 2 can be also suppressed.

Since the particle diameter of the fine pyrolized coal 2*a* entrained in the pyrolysis gas 12 is adjusted by regulating the terminal velocity of the pyrolysis gas 12 with the gas flow-velocity regulating device 110, the fine pyrolized coal 2*a* onto which the mercury-based substances are adsorbed is discharged to the combustion chamber through the exhaust line 106 together with the pyrolysis gas 12. The pyrolized coal 12 sent out from the chute 104 to the cooling device thus contains no fine pyrolized coal 2*a* onto which the mercury-based substances are physically-adsorbed or chemically-adsorbed. Accordingly, the increase of mercury concentration in the pyrolized coal 2 can be suppressed.

Figure 4:
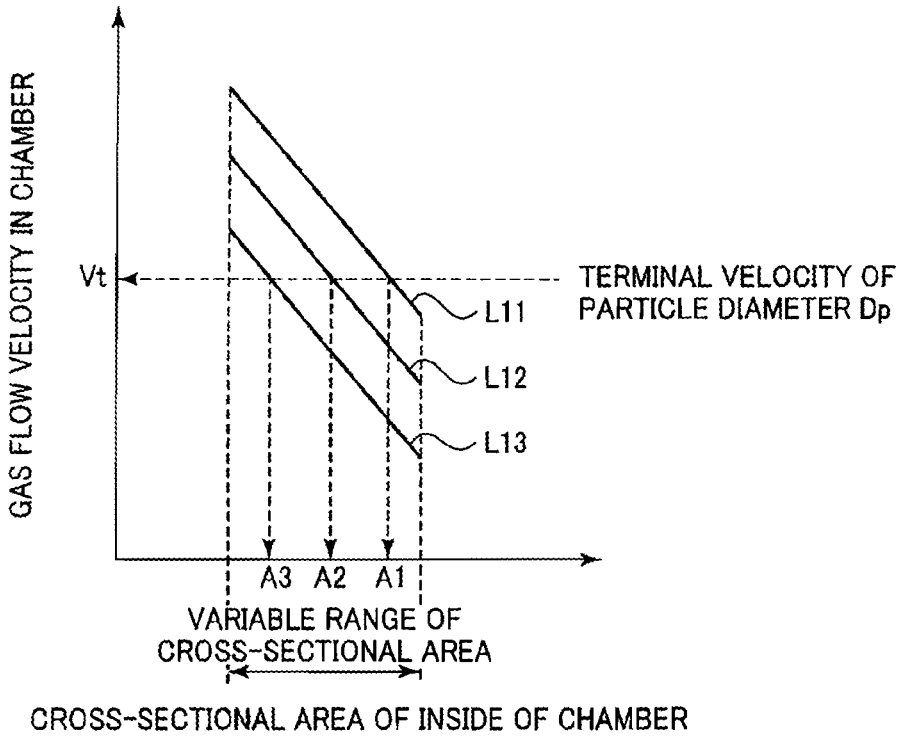
FIG. 4 is a graph showing a relationship between a gas flow velocity in a chamber (chute) of the coal pyrolizing device and the cross-sectional area of the chamber (chute).

A relationship between the cross-sectional area of the inside of the chute (chamber) 104 on the exhaust line side and the gas flow velocity (terminal velocity) in the chute (chamber) is described with reference to FIG. 4 showing an example of this relationship. The gas flow velocity of the pyrolysis gas at which the pyrolysis gas can entrain the fine pyrolized coal having a particle diameter of Dp is referred to as Vt.

When the operation load of the coal pyrolizing device 100 is 100%, the relationship between the cross-sectional area on the exhaust line 106 side and the gas flow velocity in the chute 104 is expressed by the straight line L11. From this, it is found that the gas flow-velocity which is the terminal velocity of the pyrolysis gas 12 in the chute 104 can be set to Vt by setting the chute inside cross-sectional area to A1 which is within a range that the gas flow-velocity regulating device 110 can change the cross-sectional area of the inside of the chute 104 on the exhaust line 106 side.

When the operation load of the coal pyrolizing device 100 is 80%, the relationship between the cross-sectional area on the exhaust line 106 side and the gas flow velocity in the chute 104 is expressed by the straight line L12. From this, it is found that the gas flow-velocity which is the terminal velocity of the pyrolysis gas 12 in the chute 104 can be set to Vt by setting the chute inside cross-sectional area to A2 which is within the range that the gas flow-velocity regulating device 110 can change the cross-sectional area of the inside of the chute 104 on the exhaust line 106 side.

When the operation load of the coal pyrolizing device 100 is 60%, the relationship between the cross-sectional area on the exhaust line 106 side and the gas flow velocity in the chute 104 is expressed by the straight line L13. From this, it is found that the gas flow-velocity which is the terminal velocity of the pyrolysis gas 12 in the chute 104 can be set to Vt by setting the chute inside cross-sectional area to A3 which is within the range that the gas flow-velocity regulating device 110 can change the cross-sectional area of the inside of the chute 104 on the exhaust line 106 side.

In summary, it is found that, although the amount of pyrolysis gas generated in the inner tube 102 decreases as the operation load of the coal pyrolizing device 100 becomes lower, even in such a case, the gas flow velocity of the pyrolysis gas 12 at which the fine pyrolized coal 2*a* having the particle diameter of Dp can be entrained can be maintained by making the cross-sectional area of the inside of the chute 104 on the exhaust line 106 side variable. In other words, it is found that the gas flow velocity in the chute 104 on the exhaust line 106 side can be maintained at the terminal velocity Vt of the particle diameter Dp, irrespective of the operation load of the coal pyrolizing device 100, and the fine pyrolized coal 2*a* having a particle diameter equal to or smaller than Dp can be thereby entrained in the pyrolysis gas 12.

Meanwhile, the fine pyrolized coal 2*a* onto which the mercury-based substances are physically-adsorbed or chemically-adsorbed is fed from the upper portion of the chute 104 of the coal pyrolizing device 100 to the combustion furnace through the exhaust line 106 together with the pyrolysis gas 12 and, as described above, combusted together with the inert gas (including nitrogen, carbon monoxide, and the like) and air (and also with the combustion aid as needed) to be used for the generation of the heating gas 11. At this time, the mercury-based substances such as HgS and $HgCl_2$ adsorbed onto the fine pyrolized coal 2*a* exist as gaseous Hg in the heating gas 11 with the combustion. The heating gas 11 is processed in an exhaust gas processing device after being used for the heating of the inner tube 102 of the coal pyrolizing device 100, substituted with mercury chloride, calcium sulfate, and the like to be collected, and then discharged to the outside of the system.

In the embodiment, the following is thus achieved. When the temperature of the pyrolized coal 2 drops in the portion not heated by the heating gas 11, most of the mercury-based substances in the pyrolysis gas 12 are physically-adsorbed or chemically-adsorbed onto the fine pyrolized coal 12*a* in the pyrolized coal 12 because the particle diameter of the fine pyrolized coal 2*a* is far smaller than the average particle diameter and the specific surface area per unit weight of the fine pyrolized coal 2*a* is far greater than that of the pyrolized coal of the average particle diameter. However, since the particle diameter of the fine pyrolized coal 2*a* entrained in the pyrolysis gas 12 can be adjusted by regulating the gas flow velocity of the pyrolysis gas 12 discharged from the exhaust line 106 by adjusting the cross-sectional area of the inside of the chute 104 on the exhaust line 106 side with the partition plates 113, 114 of the gas flow-velocity regulating device 110, it is possible to entrain, in the pyrolysis gas 12, the fine pyrolized coal 2*a* whose particle diameter is far smaller than the average particle diameter of the pyrolized coal and whose specific surface area per unit weight is far greater than that of the pyrolized coal of the average particle diameter, and separate the fine pyrolized coal 2*a* from the pyrolized coal 2. Hence, the increase of mercury concentration in the produced pyrolized coal 2 can be suppressed.

Second Embodiment

Figure 5A:
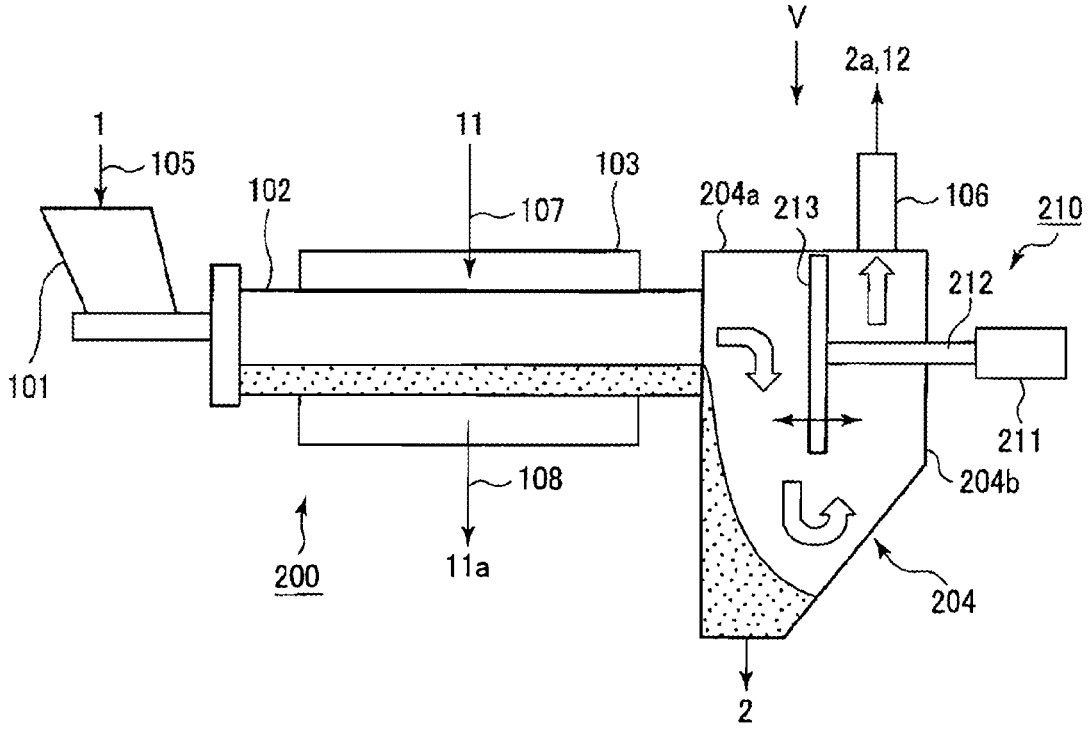
FIG. 5A shows a main portion thereof.
Figure 5B:
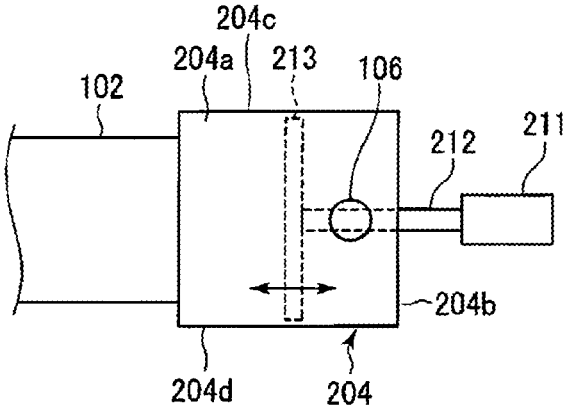
FIG. 5B shows a view in a direction of the arrow V in FIG. 5.

A second embodiment of the coal pyrolizing device of the present invention is described based on FIGS. 5A and 5B. Note that, in the embodiment, the same members as those in the coal pyrolizing device of the aforementioned first embodiment are denoted by the same reference numerals and description thereof is omitted as appropriate.

As shown in FIGS. 5A and 5B, a coal pyrolizing device 200 of the embodiment includes a chute 204 which is connected to the other end side (front end side) of the inner tube 102 to allow the inner tube 102 to rotate and which sends out pyrolized coal 2 by causing the pyrolized coal 2 to fall from the other end side (front end side) of the inner tube 102. Note that side walls 204*b*, 204*c*, and 204*d* of the chute 204 each form a flat surface.

The chute 204 is provided with a gas flow-velocity regulating device 210 which sections the chute 204 into a space including a portion communicating with the inner tube 102 and a space including a portion connected to the exhaust line 106 while allowing the pyrolysis gas 12 and the fine pyrolized coal 2*a* to be exhausted and which can change the sizes of these spaces and regulate the terminal velocity being the flow velocity of the pyrolysis gas 12. The gas flow-velocity regulating device 210 includes a drive cylinder 211, a cylinder rod (shaft body) 212 of the drive cylinder 211, and a partition plate 213 which is provided on the cylinder rod 212 and which advances and retreats in front-rear directions along a top plate 204*a* and the side walls 204*c*, 204*d* of the chute 104 with advance and retreat of the cylinder rod 212. Note that the cylinder rod 212 is formed in a shape extending toward the inner tube 102.

The size of the partition plate 213 is substantially the same as that of a space between the side walls 204*c*, 204*d* of the chute 204, and the partition plate 213 is a plate body large enough to extend from the top plate 204*a* of the chute 204 to below the portion communicating with the inner tube 102. The partition plate 213 is made of the same material as the chute 204 and is made of, for example, a steel plate. When the cylinder rod 212 is extended by an actuation the drive cylinder 211 performed by controlling the drive cylinder 211, the partition plate 213 is moved toward the inner tube 102 with this extension. When the cylinder rod 212 is contracted, the partition plate 213 is moved away from the inner tube 102 with this contraction and is moved toward the side wall 204*b* of the chute 204.

The aforementioned terminal velocity of the pyrolysis gas 12 is the speed at the time when the pyrolysis gas 12 is discharged from the inside of the chute 204 to the exhaust line 106 as in the aforementioned first embodiment. The terminal velocity of the pyrolysis gas 12 changes depending on the size of a horizontal cross section of a space formed below the exhaust line 106 by the chute 204 and the partition plate 213. There is a correlation between the terminal velocity of the pyrolysis gas 12 and the particle diameter of the fine pyrolized coal 12*a* entrained in the pyrolysis gas 12. The particle diameter of the fine pyrolized coal 2*a* entrained in the pyrolysis gas 12 becomes larger as the terminal velocity of the pyrolysis gas 12 becomes faster, and the particle diameter of the fine pyrolized coal 2*a* entrained in the pyrolysis gas 12 becomes smaller as the terminal velocity of the pyrolysis gas 12 becomes slower.

Note that, in the embodiment, the coal pyrolizing device 200 is formed of the hopper 101, the inner tube 102, the outer tube 103, the chute 204, the gas flow-velocity regulating device 210, and the like; the pyrolized coal discharging means is formed of the chute 204 and the like; the gas discharging means is formed of the chute 204, the exhaust line 106, and the like; and the gas flow-velocity regulating device 210 which is the gas flow-velocity regulating means is formed of the drive cylinder 211, the cylinder rod 212, the partition plate 213, and the like.

The coal pyrolizing device 200 of the embodiment including the gas flow-velocity regulating device 210 described above can produce the pyrolized coal 2 from the dry coal 1 by performing main operations as in the case of the coal pyrolizing device 100 of the aforementioned first embodiment.

Moreover, the cylinder rod 212 is extended and contracted by the actuation the drive cylinder 211, and the partition plate 213 is advanced toward and retreated from the inner tube 102 of the chute 204 to adjust the size of the horizontal cross section of the region surrounded by the partition plate 213 and the chute 204 below the exhaust line 106. The terminal velocity of the pyrolysis gas 12 is thereby regulated and the particle diameter of the fine pyrolized coal 2*a* entrained in the pyrolysis gas 12 is adjusted depending on the terminal velocity of the pyrolysis gas 12. The mercury-based substances in the pyrolysis gas 12 are physically-adsorbed onto the pyrolized coal in the portion of the inner tube 102 close to the other end where the temperature drops from that in the center of the inner tube 102 in the axial direction, i.e. the portion not covered with the outer tube 103 and not heated by the heating gas 11. However, the mercury-based substances are physically-adsorbed onto the fine pyrolized coal 2*a* of the pyrolized coal 2, and the fine pyrolized coal 2*a* is entrained in the pyrolysis gas 12 to be discharged from the exhaust line 106 to the combustion furnace. In other words, the pyrolized coal 2 sent out from a lower portion of the chute 204 is coal onto which only a small amount of the mercury-based substances are adsorbed.

Accordingly, in the embodiment, as in the aforementioned embodiment, since the particle diameter of the fine pyrolized coal 2*a* entrained in the pyrolysis gas 12 can be adjusted by regulating the gas flow velocity of the pyrolysis gas 12 discharged from the exhaust line 106 by adjusting the cross-sectional area of the inside of the chute 204 on the exhaust line 106 side with the partition plate 213 of the gas flow-velocity regulating device 210, it is possible to entrain, in the pyrolysis gas 12, the fine pyrolized coal 2*a* whose particle diameter is far smaller than the average particle diameter of the pyrolized coal and whose specific surface area per unit weight is far greater than that of the pyrolized coal of the average particle diameter, and separate the fine pyrolized coal 2*a* from the pyrolized coal 2. Hence, the increase of mercury concentration in the produced pyrolized coal 2 can be suppressed.

Third Embodiment

Figure 6A:
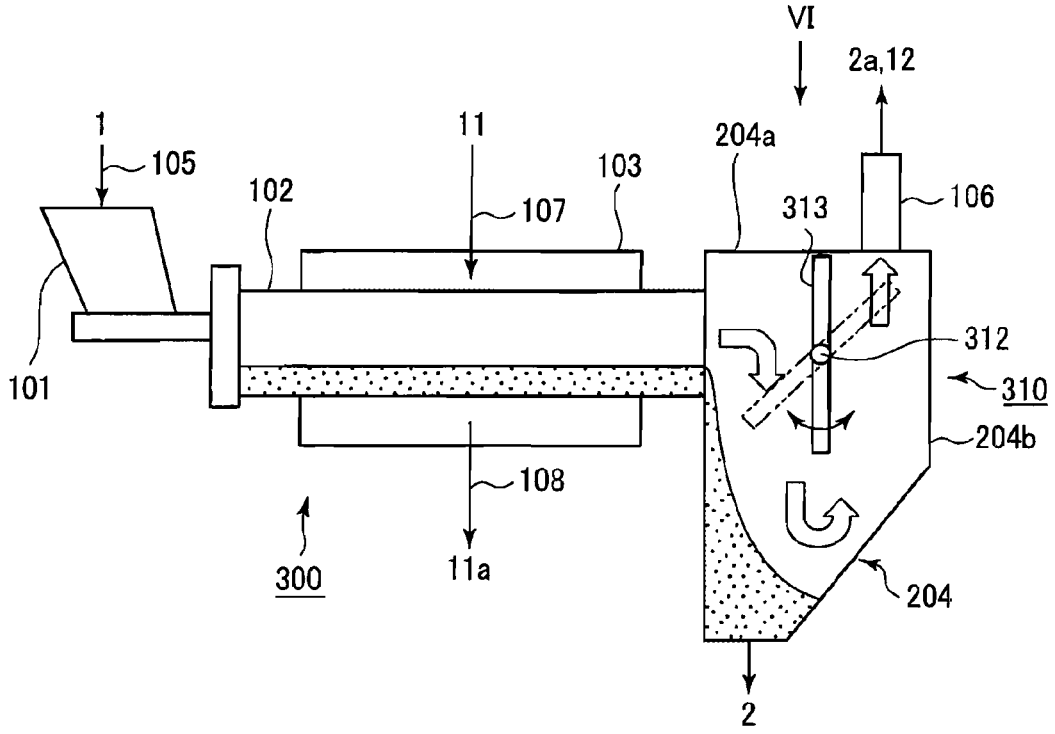
FIG. 6A shows a main portion thereof.
Figure 6B:
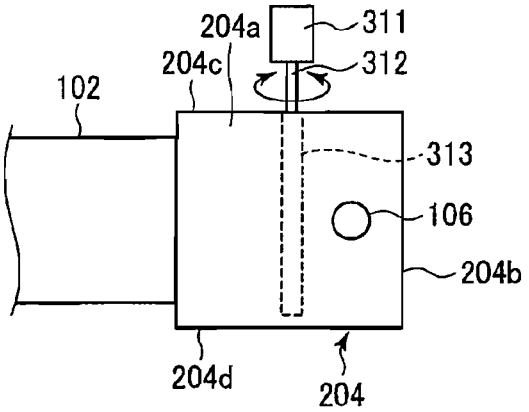
FIG. 6B shows a view in a direction of the arrow VI in FIG. 3.

A third embodiment of the coal pyrolizing device of the present invention is described based on FIGS. 6A and 6B. Note that, in the embodiment, the same members as those in the coal pyrolizing device of the aforementioned second embodiment are denoted by the same reference numerals and description thereof is omitted as appropriate.

As shown in FIGS. 6A and 6B, a coal pyrolizing device 300 of the embodiment includes a gas flow-velocity regulating device 310 provided in the chute 204. The gas flow-velocity regulating device 310 sections the chute 204 into a space including a portion communicating with the inner tube 102 and a space including a portion connected to the exhaust line 106 while allowing the pyrolysis gas 12 and the fine pyrolized coal 2*a* to be exhausted and can change the sizes of these spaces and regulate the terminal velocity being the flow velocity of the pyrolysis gas 12.

The gas flow-velocity regulating device 310 includes a motor 311, an output shaft (shaft body) 312 of the motor 311, and a partition plate 313 which is provided on the output shaft 312 and whose one end portion side (upper end portion side) and the other end portion side (lower end portion side) swing in directions advancing toward and retreating from the inner tube 102 with rotation of the output shaft 312. Note that the output shaft 312 is formed in a shape extending between the side walls 204*c*, 204*d* of the chute 204.

The size of the partition plate 313 is substantially the same as that of the space between the side walls 204*c*, 204*d* of the chute 204, and the partition plate 313 is a plate body large enough to extend from the top plate 204*a* of the chute 204 to below the portion communicating with the inner tube 102. The partition plate 313 is made of the same material as the chute 204 and is made of, for example, a steel plate. When the output shaft 312 is rotated by an actuation the motor 311 performed by controlling the motor 311, the one end portion side (upper end portion side) or the other end portion side (lower end portion side) of the partition plate 313 moves toward the inner tube 102 with this rotation. Note that the partition plate 313 is configured such that a side surface portion of the one end portion side (upper end portion side) of the partition plate 313 can face a portion below the exhaust line 106 when the other end portion side (lower end portion side) of the partition plate 313 swings toward the inner tube 102. In this case, part of the pyrolysis gas 12 flowing from the inner tube 102 into the chute 104 flows to the exhaust line 106 by going around the other end portion side (lower end portion side) of the partition plate 313 via a portion therebelow, and the remainder of the pyrolysis gas 12 hits a side surface portion of the partition plate 313 to be guided toward the exhaust line 106.

The aforementioned terminal velocity of the pyrolysis gas 12 is the speed at the time when the pyrolysis gas 12 is discharged from the inside of the chute 204 to the exhaust line 106, and changes depending on the size of a portion which is a horizontal cross section of a space formed below the exhaust line 106 by the chute 204 and the partition plate 313 and which is the smallest. There is a correlation between the terminal velocity of the pyrolysis gas 12 and the particle diameter of the fine pyrolized coal 2*a* entrained in the pyrolysis gas 12. The particle diameter of the fine pyrolized coal 2*a* entrained in the pyrolysis gas 12 becomes larger as the terminal velocity of the pyrolysis gas 12 becomes faster, and the particle diameter of the fine pyrolized coal 2*a* entrained in the pyrolysis gas 12 becomes smaller as the terminal velocity of the pyrolysis gas 12 becomes slower.

Note that, in the embodiment, the coal pyrolizing device 300 is formed of the hopper 101, the inner tube 102, the outer tube 103, the chute 204, the gas flow-velocity regulating device 310, and the like; the pyrolized coal discharging means is formed of the chute 204 and the like; the gas discharging means is formed of the chute 204, the exhaust line 106, and the like; and the gas flow-velocity regulating device 310 which is the gas flow-velocity regulating means is formed of the motor 311, the output shaft 312, the partition plate 313, and the like.

The coal pyrolizing device 300 of the embodiment including the gas flow-velocity regulating device 310 described above can produce the pyrolized coal 2 from the dry coal 1 by performing main operations as in the case of the coal pyrolizing device 200 of the aforementioned second embodiment.

Moreover, the output shaft 312 is rotated by the actuation the motor 311, and the partition plate 313 is swung to adjust the size of the horizontal cross section of the region surrounded by the partition plate 313 and the chute 204. The terminal velocity of the pyrolysis gas 12 is thereby regulated, and the particle diameter of the fine pyrolized coal 2*a* entrained in the pyrolysis gas 12 is set depending on the terminal velocity of the pyrolysis gas 12. The mercury-based substances in the pyrolysis gas 12 are physically-adsorbed onto the pyrolized coal in the portion of the inner tube 102 close to the other end where the temperature drops from that in the center of the inner tube 102 in the axial direction, i.e. the portion not covered with the outer tube 103 and not heated by the heating gas 11. However, the mercury-based substances are physically-adsorbed onto the fine pyrolized coal 2*a* of the pyrolized coal 2, and the fine pyrolized coal 2*a* is entrained in the pyrolysis gas 12 to be discharged from the exhaust line 106 to the combustion furnace. In other words, the pyrolized coal 2 sent out from a lower portion of the chute 204 is coal onto which only a small amount of the mercury-based substances are adsorbed.

Accordingly, in the embodiment, as in the aforementioned embodiments, since the particle diameter of the fine pyrolized coal 2*a* entrained in the pyrolysis gas 12 can be adjusted by regulating the gas flow velocity of the pyrolysis gas 12 discharged from the exhaust line 106 by adjusting the cross-sectional area of the inside of the chute 204 on the exhaust line 106 side with the partition plate 313 of the gas flow-velocity regulating device 310, it is possible to entrain, in the pyrolysis gas 12, the fine pyrolized coal 2*a* whose particle diameter is far smaller than the average particle diameter of the pyrolized coal and whose specific surface area per unit weight is far greater than that of the pyrolized coal of the average particle diameter, and separate the fine pyrolized coal 2*a* from the pyrolized coal 2. Hence, the increase of mercury concentration in the produced pyrolized coal 2 can be suppressed.

Fourth Embodiment

Figure 7A:
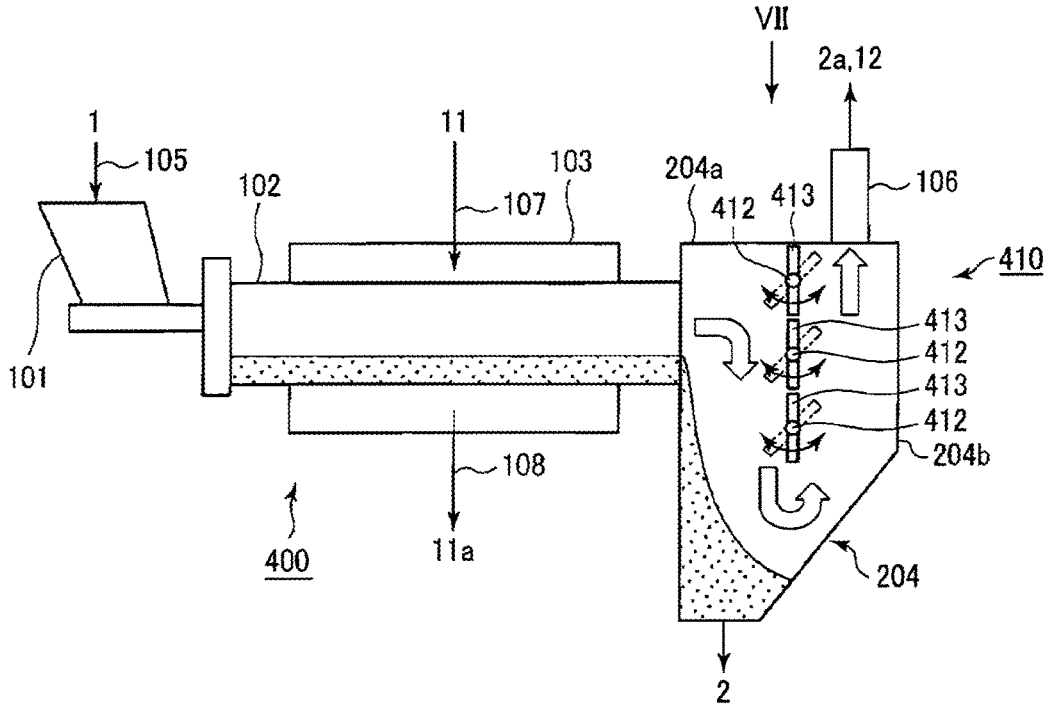
FIG. 7A shows a main portion thereof.
Figure 7B:
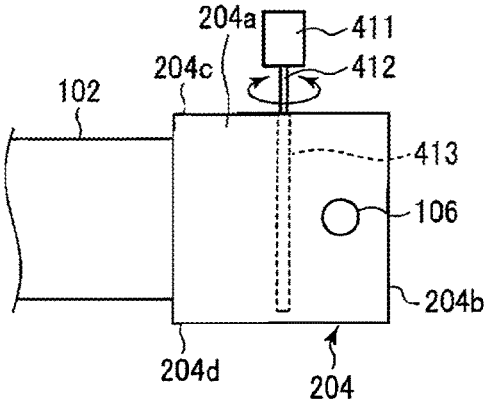
FIG. 7B shows a view in a direction of the arrow VII in FIG. 7.

A fourth embodiment of the coal pyrolizing device of the present invention is described based on FIGS. 7A and 7B. Note that, in the embodiment, the same members as those in the coal pyrolizing device of the aforementioned third embodiment are denoted by the same reference numerals and description thereof is omitted as appropriate.

As shown in FIGS. 7A and 7B, a coal pyrolizing device 400 of the embodiment includes a gas flow-velocity regulating device 410 provided in the chute 204. The gas flow-velocity regulating device 410 sections the chute 204 into a space including a portion communicating with the inner tube 102 and a space including a portion connected to the exhaust line 106 while allowing the pyrolysis gas 12 and the fine pyrolized coal 2*a* to be exhausted and can change the sizes of these spaces and regulate the terminal velocity being the flow velocity of the pyrolysis gas 12.

The gas flow-velocity regulating device 410 includes multiple (three in the illustrated example) sets each formed of a motor 411, an output shaft (shaft body) 412 of the motor 411, and a partition plate 413 which is provided on the output shaft 412 and whose one end portion side (upper end portion side) and the other end portion side (lower end portion side) swing in directions advancing toward and retreating from the inner tube 102 with rotation of the output shaft 412. These sets are provided adjacent to one another in the height direction of the chute 204. The bottom set is provided below the portion of the chute 204 communicating with the inner tube 102. Note that the output shafts 412 are each formed in a shape extending between the side walls 204*c*, 204*d* of the chute 204.

Each of the partition plates 413 is a plate body having substantially the same size as the space between the side walls 204*c*, 204*d* of the chute 204. The partition plates 413 are made of the same material as the chute 204 and are made of, for example, steel plates. When each of the output shafts 412 is rotated by an actuation the corresponding motor 411 performed by controlling motor 411, the one end portion side (upper end portion side) or the other end portion side (lower end portion side) of the corresponding partition plate 413 moves toward the inner tube 102 with this rotation.

As in the case of the aforementioned gas flow-velocity regulating device 310, the aforementioned terminal velocity of the pyrolysis gas 12 is the speed at the time when the pyrolysis gas 12 is discharged from the inside of the chute 204 to the exhaust line 106, and changes depending on the size of a portion which is a horizontal cross section of a space formed below the exhaust line 106 by the chute 204 and each of the partition plates 413 and which is the smallest. There is a correlation between the terminal velocity of the pyrolysis gas 12 and the particle diameter of the fine pyrolized coal 2*a* entrained in the pyrolysis gas 12. The particle diameter of the fine pyrolized coal 2*a* entrained in the pyrolysis gas 12 becomes larger as the terminal velocity of the pyrolysis gas 12 becomes faster, and the particle diameter of the fine pyrolized coal 2*a* entrained in the pyrolysis gas 12 becomes smaller as the terminal velocity of the pyrolysis gas 12 becomes slower.

Note that, in the embodiment, the coal pyrolizing device 400 is formed of the hopper 101, the inner tube 102, the outer tube 103, the chute 204, the gas flow-velocity regulating device 410 and the like; the pyrolized coal discharging means is formed of the chute 204 and the like; the gas discharging means is formed of the chute 204, the exhaust line 106, and the like; and the gas flow-velocity regulating device 410 which is the gas flow-velocity regulating means is formed of the motors 411, the output shafts 412, the partition plates 413, and the like.

The coal pyrolizing device 400 of the embodiment including the gas flow-velocity regulating device 410 described above can produce the pyrolized coal 2 from the dry coal 1 by performing main operations as in the case of the coal pyrolizing device 300 of the aforementioned third embodiment.

Moreover, each of the output shafts 412 is rotated by the actuation the corresponding motor 411, and the corresponding partition plate 413 is swung to adjust the size of the horizontal cross section of the region surrounded by the partition plate 413 and the chute 204. The terminal velocity of the pyrolysis gas 12 is thereby regulated, and the particle diameter of the fine pyrolized coal 2*a* entrained in the pyrolysis gas 12 is set depending on the terminal velocity of the pyrolysis gas 12. The mercury-based substances in the pyrolysis gas 12 are physically-adsorbed onto the pyrolized coal in the portion of the inner tube 102 close to the other end where the temperature drops from that in the center of the inner tube 102 in the axial direction, i.e. the portion not covered with the outer tube 103 and not heated by the heating gas 11. However, the mercury-based substances are physically-adsorbed onto the fine pyrolized coal 2*a* of the pyrolized coal 2, and the fine pyrolized coal 2*a* is entrained in the pyrolysis gas 12 to be discharged from the exhaust line 106 to the combustion furnace. In other words, the pyrolized coal 2 sent out from a lower portion of the chute 204 is coal onto which only a small amount of the mercury-based substances are adsorbed.

Accordingly, in the embodiment, as in the aforementioned embodiments, since the particle diameter of the fine pyrolized coal 2*a* entrained in the pyrolysis gas 12 can by adjusted by regulating the gas flow velocity of the pyrolysis gas 12 discharged from the exhaust line 106 by adjusting the cross-sectional area of the inside of the chute 204 on the exhaust line 106 side with the partition plates 413 of the gas flow-velocity regulating device 410, it is possible to entrain, in the pyrolysis gas 12, the fine pyrolized coal 2*a* whose particle diameter is far smaller than the average particle diameter of the pyrolized coal and whose specific surface area per unit weight is far greater than that of the pyrolized coal of the average particle diameter, and separate the fine pyrolized coal 2*a* from the pyrolized coal 2. Hence, the increase of mercury concentration in the produced pyrolized coal 2 can be suppressed.

Fifth Embodiment

Figure 8:
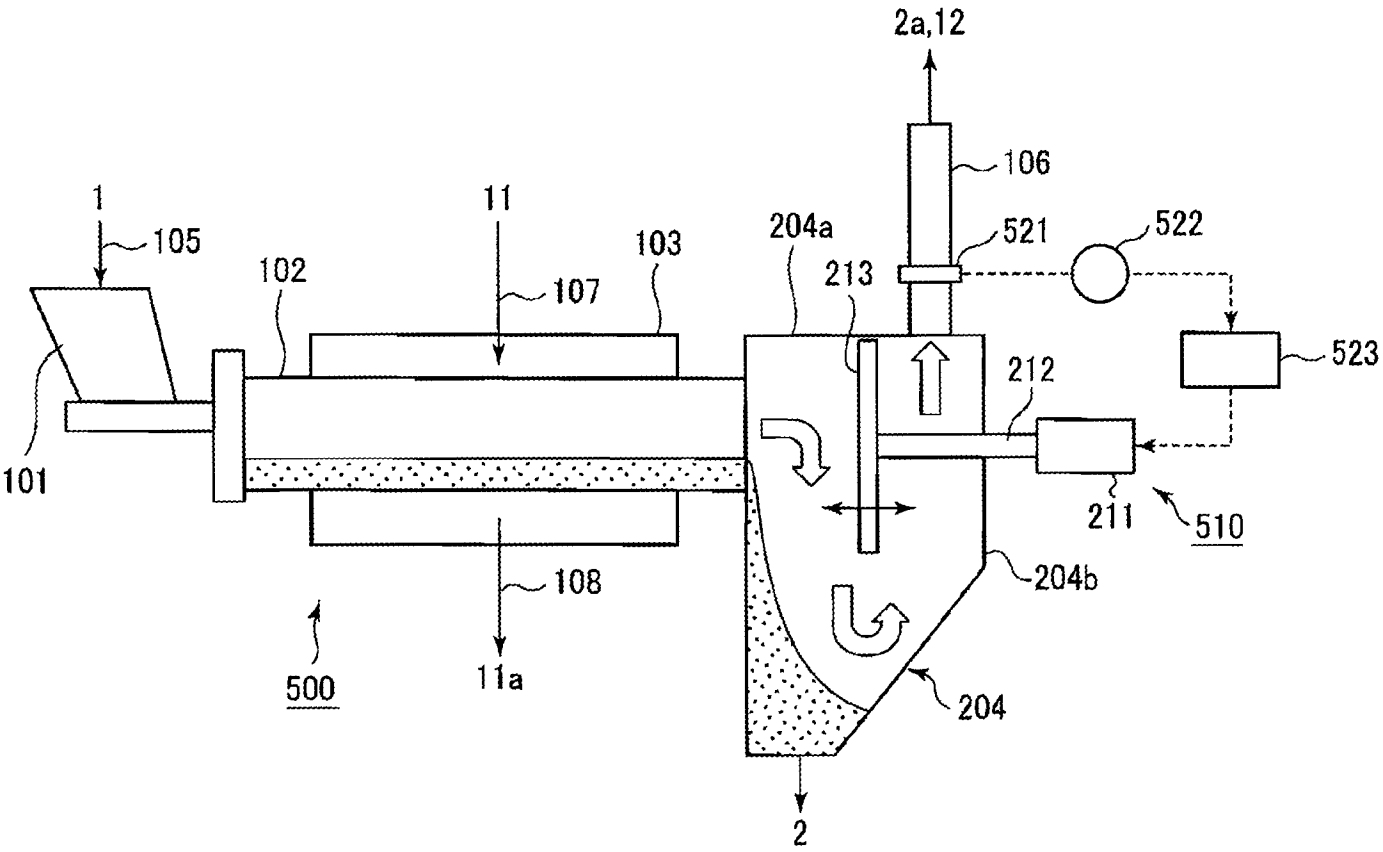
FIG. 8 is a schematic configuration diagram of a fifth embodiment of the coal pyrolizing device in the present invention.

A fifth embodiment of the coal pyrolizing device of the present invention is described based on FIG. 8. Note that, in the embodiment, the same members as those in the coal pyrolizing device of the aforementioned second embodiment are denoted by the same reference numerals and description thereof is omitted as appropriate.

As shown in FIG. 8, a coal pyrolizing device 500 of the embodiment includes a gas flow-velocity regulating device 510 including a gas flow-velocity detector (gas flow-velocity sensor) 521 which is provided in the exhaust line 106 and which detects the flow velocity of the pyrolysis gas 12 flowing in the exhaust line 106, a flow meter 522 which is electrically connected to the gas flow-velocity detector 521, and a control device 523 whose input side is electrically connected to the flowmeter 522 and whose output side is electrically connected to the drive cylinder 211.

Note that, in the embodiment, the coal pyrolizing device 500 is formed of the hopper 101, the inner tube 102, the outer tube 103, the chute 204, the gas flow-velocity regulating device 510 and the like; the pyrolized coal discharging means is formed of the chute 204 and the like; the gas discharging means is formed of the chute 204, the exhaust line 106, and the like; the gas flow-velocity regulating device 510 which is the gas flow-velocity regulating means is formed of the drive cylinder 211, the output shaft 212, the partition plate 213, the gas flow-velocity detector 521, the flow meter 522, the control device 523, and the like: gas state detecting means is formed of the gas flow-velocity detector 521, the flowmeter 522, the control device 523 and the like; and control means is formed of the control device 523 and the like.

The coal pyrolizing device 500 of the embodiment including the gas flow-velocity regulating device 510 described above can produce the pyrolized coal 2 from the dry coal 1 by performing main operations as in the case of the coal pyrolizing device 200 of the aforementioned second embodiment.

When the gas flow-velocity detector 521 detects the flow velocity of the pyrolysis gas 12 flowing in the exhaust line 106, the detection value of this flow velocity is displayed on the flow meter 522 and is also sent to the control device 523. The control device 523 causes the partition plate 213 to be moved by the actuation the drive cylinder 211 on the basis of the detection value and adjusts the size of the horizontal cross section of the region surrounded by the partition plate 313 and the chute 204. The terminal velocity of the pyrolysis gas 12 is thereby regulated, and the particle diameter of the fine pyrolized coal 2*a* entrained in the pyrolysis gas 12 is adjusted depending on the terminal velocity of the pyrolysis gas 12. The mercury-based substances in the pyrolysis gas 12 are physically-adsorbed onto the pyrolized coal in the portion of the inner tube 102 close to the other end where the temperature drops from that in the center of the inner tube 102 in the axial direction, i.e. the portion not covered with the outer tube 103 and not heated by the heating gas 11. However, the mercury-based substances are physically-adsorbed onto the fine pyrolized coal 2*a* of the pyrolized coal 2, and the fine pyrolized coal 2*a* is entrained in the pyrolysis gas 12 to be discharged from the exhaust line 106 to the combustion furnace. In other words, the pyrolized coal 2 sent out from a lower portion of the chute 204 is coal onto which only a small amount of the mercury-based substances are adsorbed.

Accordingly, in the embodiment, since the particle diameter of the fine pyrolized coal 2*a* entrained in the pyrolysis gas 12 can be adjusted by regulating the gas flow velocity of the pyrolysis gas 12 discharged from the exhaust line 106 by causing the control device 523 to control the actuation the drive cylinder 211 depending on the flow velocity of the pyrolysis gas 12 flowing through the exhaust line 106 which is detected by the gas flow-velocity detector 521 and adjust the cross-sectional area of the inside of the chute 204 on the exhaust line 106 side with the partition plate 213, it is possible to entrain, in the pyrolysis gas 12, the fine pyrolized coal 2*a* whose particle diameter is far smaller than the average particle diameter of the pyrolized coal and whose specific surface area per unit weight is far greater than that of the pyrolized coal of the average particle diameter, and separate the fine pyrolized coal 2*a* from the pyrolized coal 2. Hence, the increase of mercury concentration in the produced pyrolized coal 2 can be surely suppressed.

Sixth Embodiment

A sixth embodiment of the coal pyrolizing device of the present invention is described based on FIGS. 9A, 9B, 10, and 11. Note that, in the embodiment, the same members as those in the coal pyrolizing device of the aforementioned second embodiment are denoted by the same reference numerals and description thereof is omitted as appropriate.

Figure 9A:
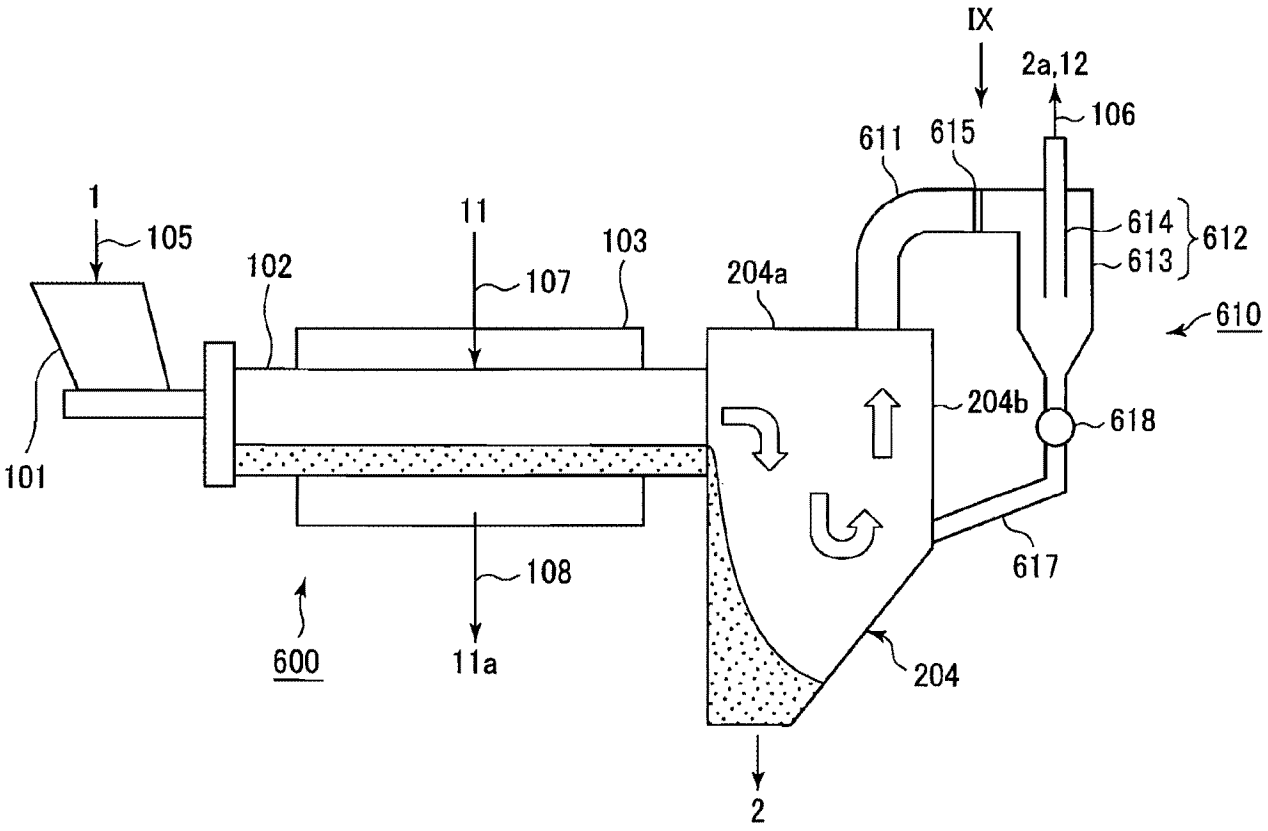
FIG. 9A shows a main portion thereof.
Figure 9B:
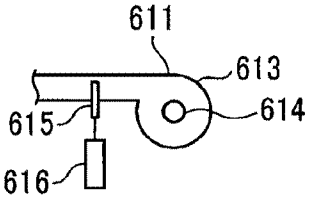
FIG. 9B shows a view in a direction of the arrow IX in FIG. 9.

As shown in FIGS. 9A and 9B, a coal pyrolizing device 600 of the embodiment includes a gas flow-velocity regulating device 610 which is provided on the chute 204. The gas flow-velocity regulating device 610 sections the chute 204 into a space including a portion communicating with the inner tube 102 and a space including a portion connected to the exhaust line 106 while allowing the pyrolysis gas 12 and the fine pyrolized coal 2*a* to be exhausted and can change the sizes of these spaces and regulate an entrance flow velocity of the pyrolysis gas 12 into a centrifuge 612.

The gas flow-velocity regulating device 610 includes a feed pipe 611 which is connected to the top plate 204*a* of the chute 204, the centrifuge 612 which is connected to the feed pipe 611, a partition plate (shield wall) 615 which is provided in the feed pipe 611 to be movable by a drive cylinder 616, a discharge pipe 617 whose one end portion side is connected to the centrifuge 612 and which is connected to the side wall 204*b* of the chute 204, and a rotary valve 618 which is provided in the middle of the discharge pipe 617. The centrifuge 612 includes an inner tube 614 which has a small diameter and whose one end portion side (front end portion side) is connected to the exhaust line 106 and an outer tube 613 which covers the inner tube 614 and whose one end portion side (upper end portion side) and other end portion side (lower end portion side) are connected respectively to the feed pipe 611 and the discharge pipe 617.

The partition plate 615 is a plate body formed in a shape larger than the diameter of the feed pipe 611. The partition plate 615 is made of the same material as the chute 204 and is made of, for example, a steel plate. When a cylinder rod of the drive cylinder 616 is extended by the actuation the drive cylinder 616, the partition plate 615 is moved with this extension to block the feed pipe 611. When the cylinder rod is contracted, the partition plate 615 is moved with this contraction to fully open the feed pipe 611. In other words, the partition plate 615 can adjust a radial cross-sectional area through which the pyrolysis gas 12 and the fine pyrolized coal 2*a* can flow in the feed pipe 611.

Figure 10:
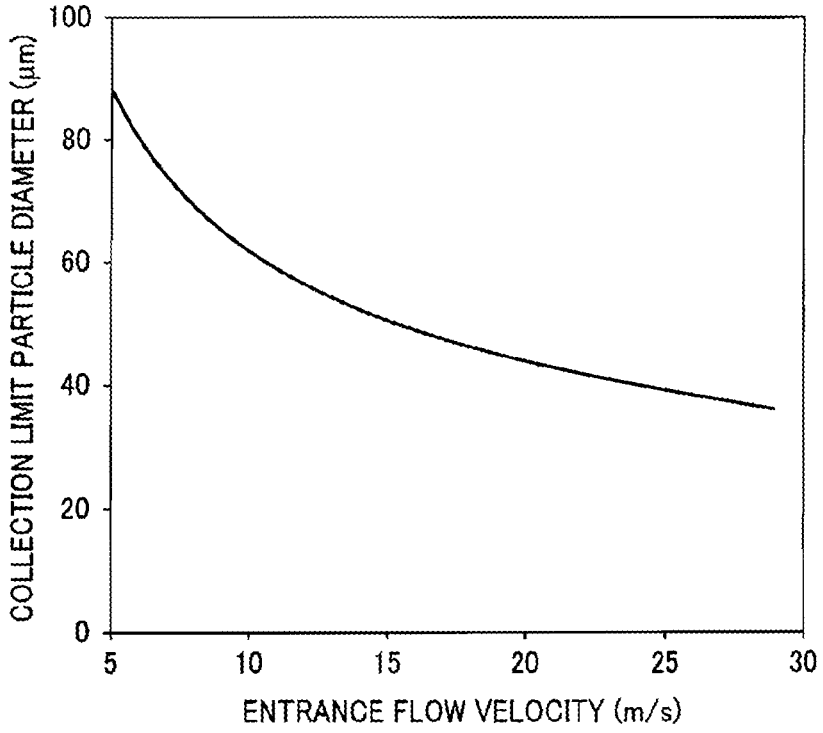
FIG. 10 is a graph showing a relationship between an entrance flow velocity into a centrifuge included in the coal pyrolizing device and a collection limit particle diameter.

The aforementioned entrance flow velocity of the pyrolysis gas 12 into the centrifuge 612 is the speed at the time when the pyrolysis gas 12 flows from the inside of the chute 204 into centrifuge 612 through the feed pipe 611 of the gas flow-velocity regulating device 610, and changes depending on the size of the radial cross-sectional area of a space formed by the feed pipe 611 and the partition plate 615. There is a correlation between the entrance flow velocity into the centrifuge 612 determined by the partition plate 615 of the feed pipe 611 which is the entrance flow velocity of the pyrolysis gas 12 into the centrifuge 612 and the particle diameter of the fine pyrolized coal 2*a* entrained in the pyrolysis gas 12, in other words, the particle diameter of the pyrolized coal collectable by the centrifuge 612 (collection limit particle diameter). As shown in FIG. 10, in centrifugation of fine particles by the centrifuge 612, the collection limit particle diameter becomes smaller in proportion to the one-half power to the entrance flow velocity Vi at the partition plate 615 of the feed pipe 611. In other words, as the entrance flow velocity becomes faster, the limit of the collectable particle diameter becomes smaller and the particle diameter of the fine pyrolized coal 2*a* not collected and entrained in the pyrolysis gas 12 becomes smaller. Accordingly, it is possible to change the entrance flow velocity and control the collectable particle diameter (i.e. the particle diameter of the fine pyrolized coal not collected and conveyed to the pyrolysis gas side) by making the radial cross-sectional area of the feed pipe 611 variable by using the partition plate 615. When the entrance flow velocity of the pyrolysis gas 12 into the centrifuge 612 becomes faster, the particle diameter of the fine pyrolized coal 2*a* entrained in the pyrolysis gas 12 becomes smaller. When the entrance flow velocity of the pyrolysis gas 12 into the centrifuge 612 becomes slower, the particle diameter of the fine pyrolized coal 2*a* entrained in the pyrolysis gas 12 becomes greater.

Note that, in the embodiment, the coal pyrolizing device 600 is formed of the hopper 101, the inner tube 102, the outer tube 103, the chute 204, the gas flow-velocity regulating device 610, and the like; the pyrolized coal discharging means is formed of the chute 204 and the like; the gas discharging means is formed of the chute 204, the exhaust line 106, the gas flow-velocity regulating device 610, and the like; the gas flow-velocity regulating device 610 which is the gas flow-velocity regulating means is formed of the feed pipe 611, the centrifuge 612, the outer tube 613, the inner tube 614, the partition plate (shield wall) 615, the drive cylinder 616, the discharge pipe 617, the rotary valve 618, and the like.

The coal pyrolizing device 600 of the embodiment including the gas flow-velocity regulating device 610 described above can produce the pyrolized coal 2 from the dry coal 1 by performing main operations as in the case of the coal pyrolizing device 200 of the aforementioned second embodiment.

Figure 11:
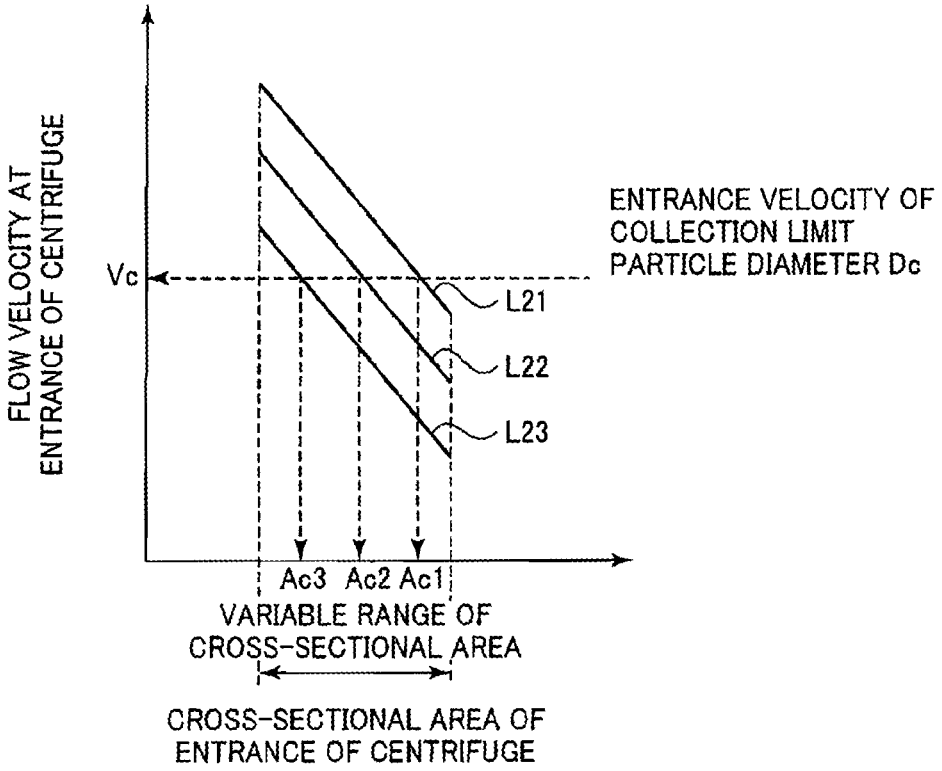
FIG. 11 is a graph showing a relationship between a flow velocity at an entrance of the centrifuge and a cross-sectional area of the entrance.

A relationship between the cross-sectional area (entrance cross-sectional area of the centrifuge 612) of the feed pipe 611 determined by the partition plate 615 and the entrance flow velocity into the centrifuge 612 which is the gas flow velocity of the pyrolysis gas 12, discharged to the exhaust line side through the feed pipe 611, at the partition plate 615 is described with reference to FIG. 11 showing an example of the relationship. The gas flow velocity of the pyrolysis gas at which the pyrolysis gas can entrain and collect the fine pyrolized coal having a particle diameter of Dc is referred to as Vc.

When the operation load of the coal pyrolizing device 600 is 100%, the relationship between the cross-sectional area of the entrance of the centrifuge 612 determined by the partition plate (shield wall) 615 of the feed pipe 611 and the gas flow velocity in the feed pipe 611 forming the entrance of the centrifuge 612 is expressed by the straight line L21. From this, it is found that the gas flow velocity which is the entrance flow velocity of the pyrolysis gas 12 into the centrifuge 612 in the feed pipe 611 can be set to Vc by setting the cross-sectional area of the feed pipe 611 to Ac1 which is within a range that the partition plate 615 of the gas flow-velocity regulating device 610 can change the cross-sectional area of the inside of the feed pipe 611.

When the operation load of the coal pyrolizing device 600 is 80%, the relationship between the cross-sectional area of the entrance of the centrifuge 612 determined by the partition plate (shield wall) 615 of the feed pipe 611 and the gas flow velocity in the feed pipe 611 forming the entrance of the centrifuge 612 is expressed by the straight line L22. From this, it is found that the gas flow velocity which is the entrance flow velocity of the pyrolysis gas 12 into the centrifuge 612 in the feed pipe 611 can be set to Vc by setting the cross-sectional area of the feed pipe 611 to Ac2 which is within the range that the partition plate 615 of the gas flow-velocity regulating device 610 can change the cross-sectional area of the inside of the feed pipe 611.

When the operation load of the coal pyrolizing device 600 is 60%, the relationship between the cross-sectional area of the entrance of the centrifuge 612 determined by the partition plate (shield wall) 615 of the feed pipe 611 and the gas flow velocity in the feed pipe 611 forming the entrance of the centrifuge 612 is expressed by the straight line L23. From this, it is found that the gas flow velocity which is the entrance flow velocity of the pyrolysis gas 12 into the centrifuge 612 in the feed pipe 611 can be set to Vc by setting the cross-sectional area of the feed pipe 611 to Ac3 which is within the range that the partition plate 615 of the gas flow-velocity regulating device 610 can change the cross-sectional area of the inside of the feed pipe 611.

In summary, it is found that, although the amount of the pyrolysis gas generated in the inner tube 102 decreases when the operation load of the coal pyrolizing device 600 falls to or below a rated value, even in such a case, the entrance flow velocity of the pyrolysis gas 12 into the centrifuge 612 at which the fine pyrolized coal 2*a* having the particle diameter of Dc can be entrained can be maintained by making the cross section of the feed pipe 611 variable. In other words, it is found that the gas flow velocity at the entrance of the centrifuge 612 can be maintained at the velocity Vc at which the pyrolized coal having the particle diameter of Dc can be collected, irrespective of the operation load of the coal pyrolizing device 600, and the fine pyrolized coal 2*a* having a diameter equal to or smaller than Dc can be thereby entrained in the pyrolysis gas 12.

Meanwhile, the fine pyrolized coal 2*a* onto which the mercury-based substances are physically-adsorbed or chemically-adsorbed is fed from the upper portion of the chute 204 of the coal pyrolizing device 600 to the combustion furnace through the exhaust line 106 together with the pyrolysis gas 12 and, as described above, combusted together with the inert gas (including nitrogen, carbon monoxide, and the like) and air (and also with the combustion aid as needed) to be used for the generation of the heating gas. At this time, the mercury-based substances such as HgS and $HgCl_2$ adsorbed onto the fine pyrolized coal 2*a* exist as gaseous Hg in the heating gas 11 with the combustion. The heating gas 11 is processed in the exhaust gas processing device after being used for the heating of the inner tube 102 of the coal pyrolizing device 600, substituted with mercury chloride, calcium sulfate, and the like to be collected, and then discharged to the outside of the system.

In the embodiment, the following is thus achieved. When the temperature of the pyrolized coal 2 drops in the portion not heated by the heating gas 11, most of the mercury-based substances in the pyrolysis gas 12 are physically-adsorbed or chemically-adsorbed onto the fine pyrolized coal 12*a* in the pyrolized coal 12 because the particle diameter of the fine pyrolized coal 2*a* is far smaller than the average particle diameter and the specific surface area per unit weight of the fine pyrolized coal 2*a* is far greater than that of the pyrolized coal of the average particle diameter. However, since the particle diameter of the fine pyrolized coal 2*a* entrained in the pyrolysis gas 12 can be adjusted by regulating the gas flow velocity of the pyrolysis gas 12 discharged from the feed pipe 611 toward the exhaust line 106 by adjusting the radial cross-sectional area of the inside of the feed pipe 611 with the partition plate 615 of the gas flow-velocity regulating device 610, it is possible to entrain, in the pyrolysis gas 12, the fine pyrolized coal 2*a* whose particle diameter is far smaller than the average particle diameter of the pyrolized coal and whose specific surface area per unit weight is far greater than that of the pyrolized coal of the average particle diameter, and separate the fine pyrolized coal 2*a* from the pyrolized coal 2. Hence, the increase of mercury concentration in the produced pyrolized coal 2 can be suppressed.

Other Embodiments

The aforementioned gas flow-velocity regulating device 510 can be applied to the aforementioned gas flow-velocity regulating devices 110, 310, 410, and 610.

In the above description, description is given by using the coal pyrolizing device 400 including the gas flow-velocity regulating device 410 which has the three sets each of formed of the output shaft 412 and the partition plate 413. However, the number of the sets each formed of the output shaft 412 and the partition plate 413 is not limited to three and the coal pyrolizing device may include a gas flow-velocity regulating device in which the number of the sets is two or four or more.

In the above description, description is given by using the coal pyrolizing device 300 including the gas flow-velocity regulating device 310 having the partition plate 313 in which the output shaft 312 is provided in a substantially center portion and whose one end portion side (upper end portion side) and other end portion side (lower end portion side) are swingable. However, the coal pyrolizing device may include a gas flow-velocity regulating device having a partition plate in which an output shaft is provided on one end portion side (upper end portion side) and whose other end portion side (lower end portion side) is swingable.

INDUSTRIAL APPLICABILITY

Since the coal pyrolizing devices of the present invention can suppress the increase of mercury concentration in the produced pyrolized coal, the coal pyrolizing devices can be very useful in various industries.

EXPLANATIONS OF REFERENCE NUMERALS

1 DRY COAL
2 PYROLIZED COAL
2*a* FINE PYROLIZED COAL
100 COAL PYROLIZING DEVICE
101 HOPPER
102 INNER TUBE
103 OUTER TUBE
104 CHUTE
105 DRY COAL CONVEYING LINE
106 EXHAUST LINE
107 HEATING GAS FEED LINE
108 EXHAUST GAS LINE
110 GAS FLOW-VELOCITY REGULATING DEVICE
111 MOTOR
112 OUTPUT SHAFT (SHAFT BODY)
113, 114 PARTITION PLATE (PLATE BODY)
200 COAL PYROLIZING DEVICE
204 CHUTE
210 GAS FLOW-VELOCITY REGULATING DEVICE
211 DRIVE CYLINDER
212 CYLINDER ROD (SHAFT BODY)
213 PARTITION PLATE
300 COAL PYROLIZING DEVICE
310 GAS FLOW-VELOCITY REGULATING DEVICE
311 MOTOR
312 OUTPUT SHAFT (SHAFT BODY)
313 PARTITION PLATE
400 COAL PYROLIZING DEVICE
410 GAS FLOW-VELOCITY REGULATING DEVICE
411 MOTOR
412 OUTPUT SHAFT (SHAFT BODY)
413 PARTITION PLATE
500 COAL PYROLIZING DEVICE
510 GAS FLOW-VELOCITY REGULATING DEVICE
521 GAS FLOW-VELOCITY DETECTOR
522 FLOW METER
523 CONTROL DEVICE
600 COAL PYROLIZING DEVICE
610 GAS FLOW-VELOCITY REGULATING DEVICE
611 FEED PIPE
612 CENTRIFUGE
613 OUTER TUBE
614 INNER TUBE
615 PARTITION PLATE (SHIELD WALL)
616 DRIVE CYLINDER
617 DISCHARGE PIPE
618 ROTARY VALVE

The invention claimed is:

1. A rotary kiln-type coal pyrolizing device characterized in that an inner tube is rotatably supported inside an outer tube, heating gas is supplied into the outer tube, coal is supplied into the inner tube from one end side of the inner tube and is heated and pyrolized while being agitated and moved from the one end side to another end side of the inner tube by rotating the inner tube, pyrolized coal and pyrolysis gas are sent out from the other end side of the inner tube, and the coal pyrolizing device comprises:

a chute which is a pyrolized coal discharging means, provided to be connected to the other end side of the inner tube, for discharging the pyrolized coal downward;

gas discharging means, provided to be connected to an upper portion of the chute, for discharging the pyrolysis gas upward;

gas flow-velocity regulating means, provided in the chute, for regulating a flow velocity of the pyrolysis gas discharged to the gas discharging means, the gas flow-velocity regulating means including a partition plate which partitions a space inside the chute into a portion on the inner tube side and a portion on the gas discharging means side while allowing the pyrolysis gas to be discharged to the gas discharging means side and which is capable of adjusting a size of a horizontal cross section of the portion on the gas discharging means side in the space inside the chute;

gas state detecting means capable of detecting the flow velocity of the pyrolysis gas discharged by the gas discharging means; and control means for controlling the gas flow-velocity regulating means on the basis of the flow velocity detected by the gas state detecting means such that a terminal velocity is within a range of 0.25 m/s to 1.1 m/s, characterized in that the partition plate is formed of two plate bodies which are provided on an output shaft of a motor arranged to extend in a height direction of the chute and whose front end portion sides are swingable in a horizontal direction by an actuation of the motor, and characterized in that a side wall of the chute which faces a portion of the chute communicating with the inner tube is formed in an arc shape protruding outward in a horizontal cross section, and the two plate bodies are large enough to extend from a top plate of the chute to below the portion of the chute communicating with the inner tube, and between the output shaft of the motor and the side wall of the chute.

2. A rotary kiln-type coal pyrolizing device characterized in that an inner tube is rotatably supported inside an outer tube, heating gas is supplied into the outer tube, coal is supplied into the inner tube from one end side of the inner tube and is heated and pyrolized while being agitated and moved from the one end side to another end side of the inner tube by rotating the inner tube, pyrolized coal and pyrolysis gas are sent out from the other end side of the inner tube, and the coal pyrolizing device comprises:

a chute which is a pyrolized coal discharging means, provided to be connected to the other end side of the inner tube, for discharging the pyrolized coal downward;

gas discharging means, provided to be connected to an upper portion of the chute, for discharging the pyrolysis gas upward;

gas flow-velocity regulating means, provided in the chute, for regulating a flow velocity of the pyrolysis gas discharged to the gas discharging means, the gas flow-velocity regulating means including a partition plate which partitions a space inside the chute into a portion on the inner tube side and a portion on the gas discharging means side while allowing the pyrolysis gas to be discharged to the gas discharging means side and which is capable of adjusting a size of a horizontal cross section of the portion on the gas discharging means side in the space inside the chute;

gas state detecting means capable of detecting the flow velocity of the pyrolysis gas discharged by the gas discharging means; and control means for controlling the gas flow-velocity regulating means on the basis of the flow velocity detected by the gas state detecting means such that a terminal velocity is within a range of 0.25 m/s to 1.1 m/s, characterized in that the partition plate is formed of a plate body which is provided on a cylinder rod of a drive cylinder and which is capable of advancing toward and retreating from the inner tube by an actuation of the drive cylinder, and characterized in that the plate body is large enough to extend from a top plate of the chute to below a portion of the chute communicating with the inner tube, and between side walls of the chute located in a radial direction of the inner tube.

3. A rotary kiln-type coal pyrolizing device characterized in that an inner tube is rotatably supported inside an outer tube, heating gas is supplied into the outer tube, coal is supplied into the inner tube from one end side of the inner tube and is heated and pyrolized while being agitated and moved from the one end side to another end side of the inner tube by rotating the inner tube, pyrolized coal and pyrolysis gas are sent out from the other end side of the inner tube, and the coal pyrolizing device comprises:

a chute which is a pyrolized coal discharging means, provided to be connected to the other end side of the inner tube, for discharging the pyrolized coal downward;

gas discharging means, provided to be connected to an upper portion of the chute, for discharging the pyrolysis gas upward;

gas flow-velocity regulating means, provided in the chute, for regulating a flow velocity of the pyrolysis gas discharged to the gas discharging means, the gas flow-velocity regulating means including a partition plate which partitions a space inside the chute into a portion on the inner tube side and a portion on the gas discharging means side while allowing the pyrolysis gas to be discharged to the gas discharging means side and which is capable of adjusting a size of a horizontal cross section of the portion on the gas discharging means side in the space inside the chute;

gas state detecting means capable of detecting the flow velocity of the pyrolysis gas discharged by the gas discharging means; and control means for controlling the gas flow-velocity regulating means on the basis of the flow velocity detected by the gas state detecting means such that a terminal velocity is within a range of 0.25 m/s to 1.1 m/s, characterized in that the partition plate is formed of a plate body which is provided on an output shaft of a motor and which has at least one end portion side swingable relative to the inner tube by an actuation of the motor, and characterized in that the output shaft of the motor is arranged to extend between side walls of the chute located in a radial direction of the inner tube, and the plate body is large enough to extend from a top plate of the chute to below a portion of the chute communicating with the inner tube, and between the side walls of the chute.

4. A rotary kiln-type coal pyrolizing device characterized in that an inner tube is rotatably supported inside an outer tube, heating gas is supplied into the outer tube, coal is supplied into the inner tube from one end side of the inner tube and is heated and pyrolized while being agitated and moved from the one end side to another end side of the inner tube by rotating the inner tube, pyrolized coal and pyrolysis gas are sent out from the other end side of the inner tube, and the coal pyrolizing device comprises:

a chute which is a pyrolized coal discharging means, provided to be connected to the other end side of the inner tube, for discharging the pyrolized coal downward;

gas discharging means, provided to be connected to an upper portion of the chute, for discharging the pyrolysis gas upward;

gas flow-velocity regulating means, provided in the chute, for regulating a flow velocity of the pyrolysis gas discharged to the gas discharging means, the gas flow-velocity regulating means including a partition plate which partitions a space inside the chute into a portion on the inner tube side and a portion on the gas discharging means side while allowing the pyrolysis gas to be discharged to the gas discharging means side and which is capable of adjusting a size of a horizontal cross section of the portion on the gas discharging means side in the space inside the chute;

gas state detecting means capable of detecting the flow velocity of the pyrolysis gas discharged by the gas discharging means; and control means for controlling the gas flow-velocity regulating means on the basis of the flow velocity detected by the gas state detecting means such that a terminal velocity is within a range of 0.25 m/s to 1.1 m/s, characterized in that the partition plate is formed of a plate body which is provided on an output shaft of a motor and which has at least one end portion side swingable relative to the inner tube by an actuation of the motor, and characterized in that the output shaft of the motor is arranged to extend between side walls of the chute located in a radial direction of the inner tube, the plate body has the same size as a space between the side walls of the chute, the coal pyrolizing device comprises a plurality of sets of the plate bodies, the plurality of sets of plate bodies are arranged adjacent to one another in a height direction of the chute, and a bottom set of the plate bodies is arranged below a portion of the chute communicating with the inner tube.

* * * * *